United States Patent [19]

Merritt, Jr.

[11] 4,407,237

[45] Oct. 4, 1983

[54] ECONOMIZER WITH SOOT BLOWER

[75] Inventor: John H. Merritt, Jr., Atlanta, Ga.

[73] Assignee: Applied Engineering Co., Inc., Orangeburg, S.C.

[21] Appl. No.: 372,997

[22] Filed: Apr. 29, 1982

Related U.S. Application Data

[62] Division of Ser. No. 235,667, Feb. 18, 1981, Pat. No. 4,346,674.

[51] Int. Cl.[3] ..... F22B 37/52

[52] U.S. Cl. ..... 122/390; 122/384; 122/405; 122/421; 122/392; 384/107; 384/121; 15/316 R

[58] Field of Search ..... 122/379, 380, 383, 384, 122/390–392, 396, 405, 421; 134/167 C, 172, 168 C, 198; 308/78, 106, 109, DIG. 1; 15/316 R, 316 A, 104.04; 384/121, 107

[56] References Cited

U.S. PATENT DOCUMENTS

| | | | |
|---|---|---|---|
| 609,845 | 8/1898 | Stephenson | 122/405 |
| 1,574,981 | 3/1926 | Lippert et al. | 122/392 |
| 1,805,454 | 5/1931 | Snow et al. | 122/392 |
| 1,896,593 | 2/1933 | Purcell | 122/392 |
| 1,954,803 | 4/1934 | Doble | 122/392 |
| 2,017,846 | 10/1935 | Bayer | 122/392 |
| 2,110,532 | 3/1938 | Snow et al. | 122/392 |
| 2,775,958 | 1/1957 | Kolling | 122/392 |
| 3,152,845 | 10/1964 | Ertrand et al. | 384/121 |
| 3,322,473 | 5/1967 | Lebach | 384/121 |
| 3,541,999 | 11/1970 | Winkin | 122/392 |
| 3,701,341 | 10/1972 | Willis, Jr. | 122/392 |
| 3,717,182 | 2/1973 | Goddard | 384/121 |
| 3,785,707 | 1/1974 | Mitsuoka | 384/121 |
| 4,273,076 | 6/1981 | Laheda et al. | 122/390 |
| 4,306,754 | 12/1981 | Kraus | 384/121 |

*Primary Examiner*—Henry C. Yuen
*Attorney, Agent, or Firm*—B. J. Powell

[57] ABSTRACT

An economizer construction for use in recovering heat from flue gases is disclosed including a housing with a flue gas passage therethrough, a helically wound heat transfer coil positioned in the flue gas passage for placing a heat transfer fluid in a heat exchange relation with the flue gases passing through the flue gas passage where the heat transfer coil defines a generally vertically extending central opening therethrough, and a soot blower assembly with an elongate soot blower lance rotatably mounted in the coil central opening for directing a pressurized cleaning fluid over the heat transfer coil to periodically clean it. Different embodiments of the rotary mounting of the soot blower lance are disclosed. Also, different embodiments of the drive means for rotating the soot blower lance are disclosed.

9 Claims, 9 Drawing Figures

ECONOMIZER WITH SOOT BLOWER

CROSS REFERENCE TO RELATED APPLICATIONS

This application is a division of my co-pending application Ser. No. 235,667, filed Feb. 18, 1981 U.S. Pat. No. 4,346,674.

BACKGROUND OF THE INVENTION

During use, heat exchangers used to recover heat from flue gases (called economizers) typically collect soot on the heat exchange tubes that must be periodically removed to maintain the efficiency of the heat exchanger. This has led to the use of soot blowers to direct jets of a pressurized gas such as steam or air over the heat exchanger coils to blow the soot off the heat exchanger tubes.

In economizers where the heat exchanger tubes in the flue gas passage are oriented so that they are normal to the flue gas flow, the soot blower element can be located so that its opposite ends project out of the economizer housing for monitoring. This has permitted a rotary mounting to be used so that the soot blower element can be rotated to achieve a more thorough cleaning of the heat exchange tubes.

In economizers where the heat exchange tubes are formed in a helical coil, however, the soot blower element must be located co-axially with the flue gas flow so that its opposite ends and mountings are exposed to the flue gases. As a result, prior art soot blowers for this type of economizer have been stationarily mounted such as that shown in U.S. Pat. No. 1,954,803 (4/34). The use of a stationary soot blower does not provide the cleaning coverage required in many installations as is possible with the rotary mounting used in the straight tube economizer.

Attempts have been made in the past to provide a rotary mounted soot blower for helical coil economizers. These attempts have not been successful because the rotary mounting failed after a short period of operation.

SUMMARY OF THE INVENTION

These and other problems and disadvantages associated with prior art rotary mounted soot blowers for helical coil economizers are overcome by the invention disclosed herein by providing a rotary mounting for a soot blower which does not fail during use. In one embodiment of the invention, a lubricated bearing is used to rotatably mount the soot blower element with means to positively force lubricant into lubricating contact with the bearing. In another embodiment of the invention, the pressurized gas used with the soot blower is also used to rotatably position the soot blower element. Some embodiments of the invention show mechanical means to positively rotate the soot blower element while in other embodiments of the invention, the pressurized gas used with the soot blower is also used to rotate the soot blower element.

These and other features and advantages of the invention disclosed herein will become more apparent on consideration of the following detailed description and accompanying drawings wherein like characters of reference designate corresponding parts throughout the several views and in which:

These figures and the following detailed description disclose specific embodiments of the invention; however, it should be understood that the invention is not limited thereto since it may be embodied in other embodiments.

DETAILED DESCRIPTION OF ILLUSTRATIVE EMBODIMENTS

Figure 1:
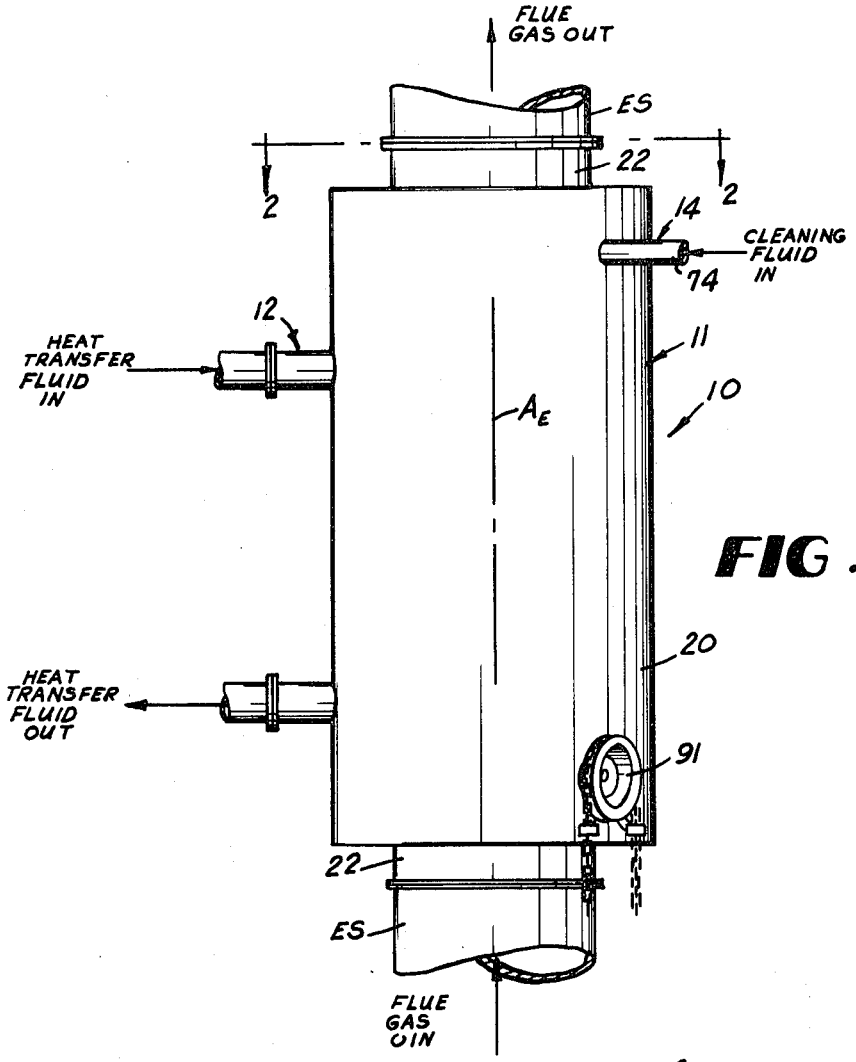
FIG. 1 is a side elevational view showing an economizer incorporating the invention.
Figure 2:
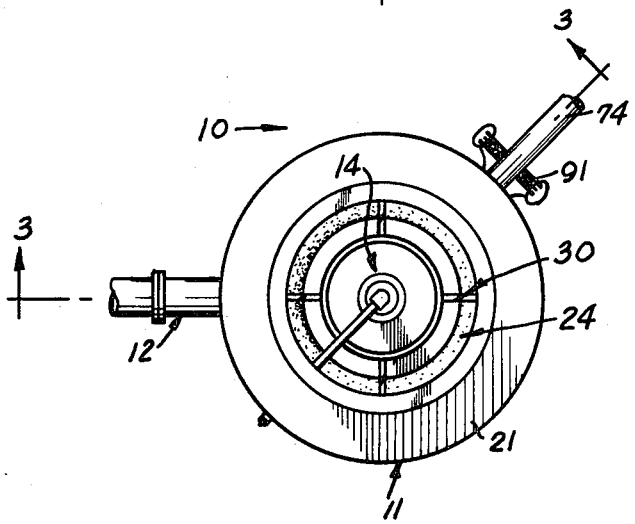
FIG. 2 is a top view of the economizer taken generally along line 2—2 in FIG. 1.

Referring to FIGS. 1 and 2, it will be seen that the invention is incorporated in an economizer 10 which is imposed in an exhaust stack ES so that the flue gases passing through the exhaust stack ES pass upwardly through the economizer 10. The economizer 10 includes a housing 11 connected in the exhaust stack ES so that the flue gases flow through the housing 11. The economizer 10 is also provided with a heat transfer coil assembly 12 carried in the housing 11 and over which the flue gases passing through the economizer 10 pass. The heat transfer coil assembly 12 places a heat transfer fluid in heat transfer contact with the flue gases passing over the heat transfer coil assembly so that heat is transferred from the flue gases into the heat transfer fluid. The economizer 10 also includes a soot blower assembly 14 which is used to periodically clean the heat transfer coil ssembly by blowing a cleaning fluid such as steam or air over the heat transfer coil assembly.

Figure 3:
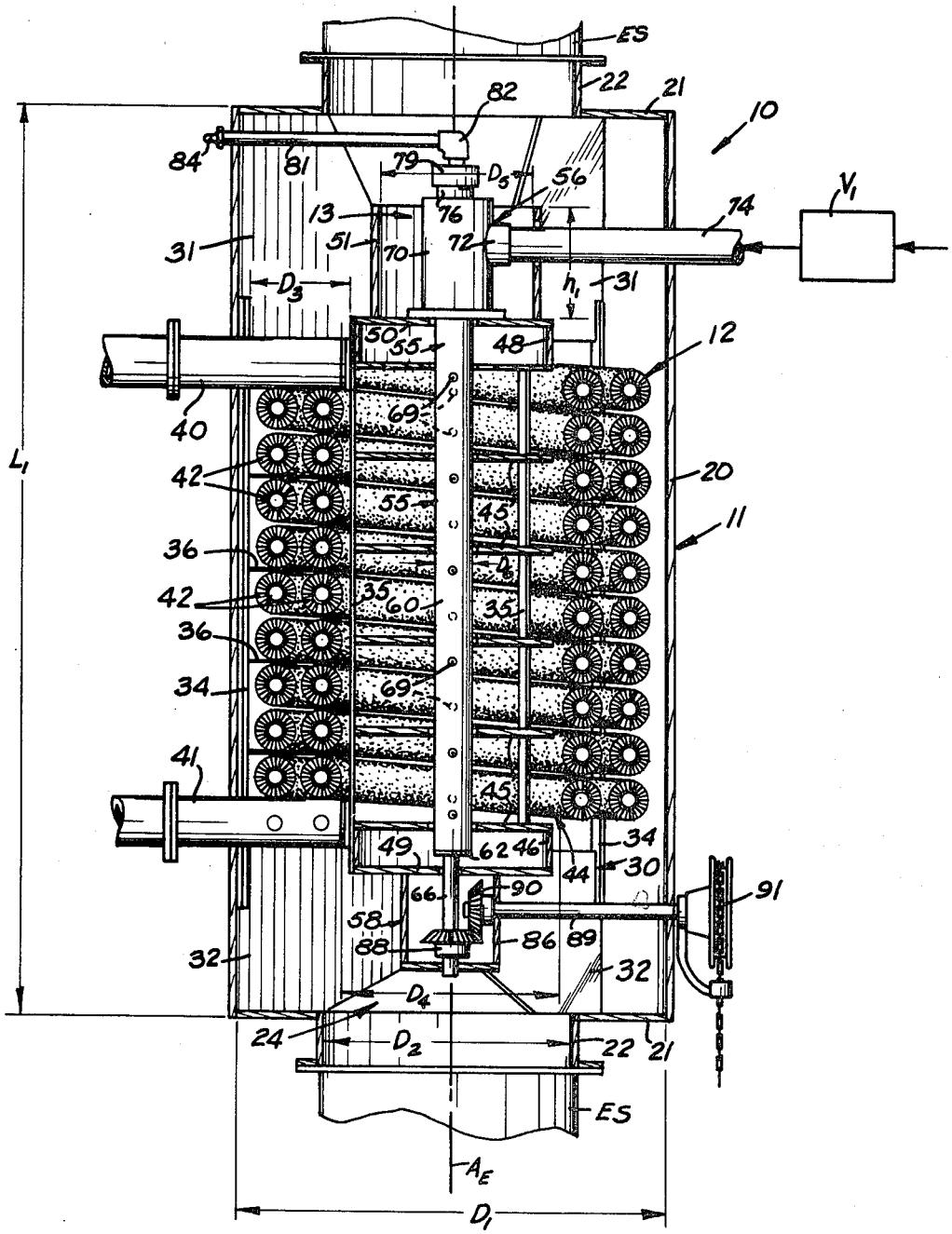
FIG. 3 is an enlarged vertical cross-sectional view taken generally along line 3—3 in FIG. 2.

As best seen in FIG. 3, housing 11 includes an annular cylindrical side wall 20 concentrically arranged about the vertical axis $A_E$ of the economizer 10, and with an inside diameter $D_1$ and length $L_1$. The upper and lower ends of the side wall 20 join with annular end walls 21 oriented generally normal to the vertical axis $A_E$ with each defining a central opening therethrough. Upper and lower inlet and outlet tubular sections 22 with inside diameters $D_2$ are connected to the end walls 21 about the openings therethrough. It will be noted that the inside diameter $D_2$ is smaller than the inside diameter $D_1$. Thus, the side wall 20, end walls 21 and wall sections 22 define a generally vertically extending flue gas passage 24 through the housing 11 through which the flue gases pass.

The heat transfer coil assembly 12 is mounted on a support assembly 30 within the flue gas passage 24 in the housing 11. The support assembly 30 includes a plurality of radially extending and vertically oriented upper support plates 31 attached to the bottom of the upper annular end wall 21 and depending therebelow. The upper support plates 31 are equally spaced circumferentially about the vertical axis $A_E$ of economizer 10. A plurality of radially extending vertically oriented lower support plates are connected to the top of the lower end walls 21 and project thereabove. The lower support plates 32 are also equally spaced circumferentially about the vertical axis $A_E$ of the economizer 10 with each of the lower support plates 32 in vertical registration with one of the upper support plates 31. A plurality of vertically extending outer suppor bars 34 joins the upper and lower support plates 31 and 32 with one of the outer support bars 34 extending between the outboard ends of each of the upper and lower support plates 31 and 32 in vertical registration with each other. The outer support bars 34 are arranged so that they extend vertically along the inside of the cylindrical side wall 20 closely adjacent thereto. A plurality of vertically extending inner support bars 35 also connect the upper and lower support plates 31 and 32 with one of the inner support bars 35 extending between each set of the vertically aligned upper and lower support plates 31 and 32. Each of the inner support bars 35 is oriented parallel to the outer support bar 34 associated therewith and is spaced inwardly therefrom a distance $D_3$ so that the inner support bars 35 are arranged concentrically about the central axis $A_E$ of the economizer. A plurality of radially extending support pins 36 are connected between each set of associated outer and inner support bars 34 and 35 to support the heat transfer coil assembly 11 as will become more apparent.

The heat transfer coil assembly 12 includes an upper header 40, a lower header 41 and a plurality of helically wound, finned heat transfer tubes 42 extending therebetween. While the number of heat transfer tubes used may be varied, depending on the size of the economizer, two such tubes are illustrated. The upper header 40 is attached to the bottom of one of the upper support plates 31 and is radially oriented with respect to the axis $A_E$. The header 40 extends across the space between the inner and outer support bars 35 and 34 and projects out through the side wall 20 of housing 11 for connection to a supply of heat transfer fluid (not shown). The lower header 41 is attached to the top of one of the lower support plates 32 and extends radially with respect to axis $A_E$. The header 41 also extends across the space between the inner and outer support bars 35 and 34 and projects out through the side wall 20 of housing 11 for connection to the return of the heat transfer fluid (not shown). One end of each of the heat transfer tubes 42 is connected to header 40 while the other end is connected to header 41 with the tubes 42 helically extending through the space between the outer and inner support bars 34 and 35 in side-by-side fashion. The support pins 36 extend between the flights of the heat transfer tubes to help maintain their spacing. Thus, it will be seen that the heat transfer fluid flows in through one of the headers, usually the upper header 40, then through the heat transfer tubes 42 for heating, and out through the other header, usually the lower header 41.

Because the innermost heat transfer tube 42 is coiled so that it lies just outboard of the inner support bars 35, a central opening 44 is defined through the heat transfer coil assembly 12 concentrically about the central axis $A_E$ with a diameter $D_4$. Also, it will be noted that the width of each of the inner support bars 35 circumferentially about the central axis $A_E$ is small so that substantially all of the length of the heat transfer tubes 42 are exposed to the opening 44 as will become more apparent.

To prevent the flue gases passing through the passage 24 in housing 11 from passing through the opening 44 in the heat transfer coil assembly 12, a plurality of circular baffle plates 45 are mounted on the inner support bars 35. The baffle plates 45 are mounted at vertically spaced apart positions along and vertically oriented with respect to the vertical axis $A_E$. The baffle plates 45 have a diameter substantially the same as that of opening 44 with one of the baffle plates blocking the lower end of opening 44, one of the baffle plates blocking the upper end of the opening 44, and the other of the baffle plates interspersed therebetween. Thus, as the flue gases flow through the flue gas passage 24, any flue gases flowing into the opening 44 is deflected back out of the opening by the next upstream baffle plate 44 so that substantially all of the flue gas stream passes into geat transfer contact with the heat transfer tubes 42.

A lower annular shield 46 extends from the lower baffle plate 45 to the top of the lower support plates 32 and an upper annular shield 48 extends from the upper baffle plate 45 to the bottom of the upper support plates 31 to further direct the flue gas flow around the opening 44. Both shields 46 and 48 have diameters similar to the baffle plates 45 and are located concentrically of the central axis $A_E$. The lower end of the lower shield 46 is closed by a circular lower mounting plate 49 also connected to the lower support plates 32 while the upper end of the upper shield 48 is closed by a circular upper mounting plate 50 also connected to the upper support plates 31.The upper and lower mounting plates 49 and 50 are used to mount the soot blower assembly 14 as will become more apparent. An annular deflector 51 is also mounted on the upper mounting plate 50 and projects upwardly therefrom concentrically about the central axis $A_E$. The deflector 51 has a diameter $D_5$ and projects upwardly from the upper mounting plate 50 for a height $h_1$.

Figure 4:
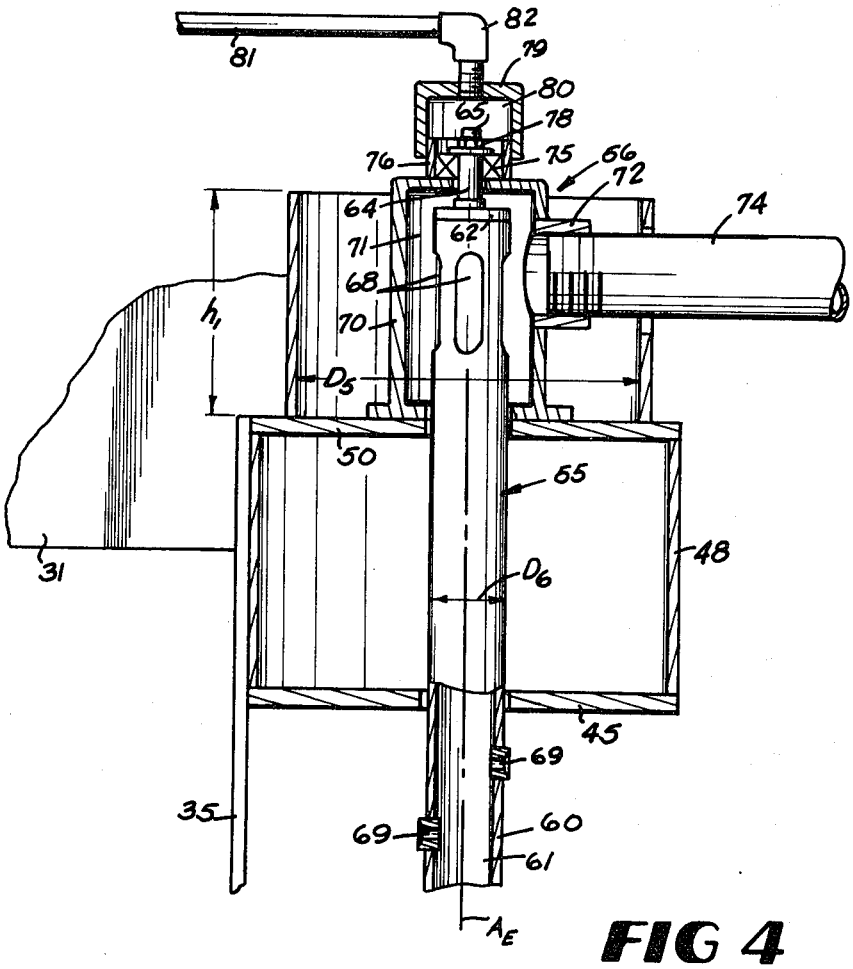
FIG. 4 is an enlarged vertical cross-sectional view taken through the rotary head of the soot blower assembly.

The soot blower assembly 14 is best seen in FIGS. 3 and 4 and includes a soot blower lance 55, a rotary head assembly 56 and a rotary drive assembly 58. The rotary head assembly 56 rotatably supports the lance 55 within the passage 44 through the heat transfer coil assembly 12 coaxially with the central axis $A_E$. The cleaning gas such as steam or air is supplied to the soot blower lance 55 through the rotary head assembly 56 so that the cleaning gas is directed over the heat transfer tubes 42 in the heat transfer coil assembly 12. The rotary drive assembly 58 is connected to the soot blower lance 55 for selectively rotating the soot blower lance 55. The rotary head assembly 56 is mounted on the upper mounting plate 50 within the deflector 51 with the upper end of the soot blower lance 55 rotatably supported thereby and depending therebelow through appropriate openings in the upper mounting plate 50, the baffle plates 45, and the lower mounting plate 49. The rotary drive assembly 58 is mounted on the lower mounting plate 49 and is connected to the lower end of the soot blower lance 55 for selectively rotating same.

The soot blower lance 55 includes a pipe 60 defining a passage 61 therethrough with the opposite ends of the pipe 60 being closed by end plates 62. The pipe 60 has an outside diameter $D_6$ considerably smaller than the diameter $D_4$ of the central opening 44 through the heat transfer coil assembly 12 as will become more apparent. Typically, the diameter $D_4$ is about 4–6 times larger than the diameter $D_6$. The pipe 60 has a length so that it projects upwardly through the upper mounting plate 50 into the rotary head assembly 56 and downwardly through the central opening 44 to a position just above the lower mounting plate 49. The length of the pipe 60 will, of course, depend on the axial length of the heat transfer coil assembly 12.

A mounting shaft 64 is attached to the end plate 62 on the upper end of pipe 606 and projects upwardly therefrom coaxially with the pipe axis. The upper projecting end of the mounting shaft 64 is provided with a threaded stud 64 for use in connecting the mounting shaft 64 and thus the soot blower lance 55 to the rotary head assembly 56. A drive shaft 66 is attached to the end plate 62 on the lower end of the pipe 60 and projects therebelow coaxially with the pipe axis so that the drive shaft 66 projects through an appropriate opening in the lower mounting plate 49. The drive shaft 66 is connected to the rotary drive assembly 58 below the lower mounting plate 49 to rotate the soot blower lance 55.

A plurality of slots 68 is provided through the pipe 60 adjacent the upper end thereof and in that portion projecting upwardly through the upper mounting plate 50 so that the cleaning gas can be introduced into the passage 61 through the pipe 60 by the rotary head assembly 56 as will become more apparent. A plurality of orifices 69 is provided through the pipe 60 at axially spaced positions along that portion of the pipe 60 located within the central opening 44 through the heat transfer coil assembly 12 to direct the cleaning gas outwardly from within the passage 61 to impinge on the heat transfer tubes 42 in the heat transfer coil assembly 12 so as to blow the soot from the heat transfer tubes 42 as will become more apparent. The orifices 69 are arranged so that they direct the cleaning gas in opposite directions from the pipe 60 to equalize the reaction forces exerted on the pipe 60 to keep the soot blower lance 55 centered along the axis $A_E$.

The rotary head assembly 56 includes a base housing 70 mounted on the top of the upper mounting plate 50 coaxially of the axis $A_E$. The base housing 70 defines an opening through the lower end thereof through which the pipe 60 of the soot blower lance 55 extends and an opening at the upper end thereof through which the mounting shaft 64 on the upper end of the soot blower lance 55 extends. Base housing 70 defines a cavity 71 therein around the upper end of the pipe 60 projecting above the upper mounting plate 50 in which the slots 68 are located. A pipe nipple 72 is provided on the housing 70 which is connected to a cleaning gas inlet pipe 74 so that the cleaning gas such as steam or air can be introduced into the cavity 71 through the inlet pipe 74 through value $V_1$. It will thus be seen that, when the cleaning gas is introduced into the cavity 71, it can pass into the passage 61 in the pipe 60 and through slots 68 and subsequently out through the orifices 69 to impinge against the heat transfer tubes 42.

A bearing 75 is positioned on the upper end of the base housing 70 by a bearing mount 76 so that the mounting shaft 64 on the upper end of the lance 55 projecting upwardly through the upper end of the base housing 70 is engaged by the bearing 75. A nut and washer assembly 78 threadedly engages the threaded stud 64 on the projecting end of the mounting shaft 64 to connect the mounting shaft 64 to the bearing 75. Thus, it will be seen that the bearing 75 axially fixes a soot blower lance 55 in the opening 44 through the heat transfer coil assembly 12, yet allows the soot blower lance 55 to be selectively rotated within the opening 44.

A grease cap 79 engages the bearing mount 76 to enclose the bearing 75 and form a lubricant cavity 80 above the bearing 75. The grease cap 79 is provided with a fill pipe unit 81 communicating with the lubricant cavity 80 opposite the bearing 75 and is provided with a 90° elbow 82 so that the fill pipe unit 81 projects radially outwardly from the axis $A_E$ across the flue gas passage 24 through the side wall 20 of housing 11. That end of the fill pipe unit k81 projecting outwardly through the side wall 20 is provided with a check valve type grease fitting 84 so that the lubricant cavity 80 and fill pipe unit 81 can be filled with grease. The height $H_1$ of the deflector 51 is selected so that the flue gases passing through the flue gas passage 24 are deflected around the rotary head assembly 56 while that portion of the fill pipe unit 81 projecting across the flue gas passage 24 is exposed to the flue gases passing thereover. This heats the lubricant in that portion of the fill pipe unit 81 exposed to the flue gases sufficiently to generate a pressure within the lubricant positively forcing the lubricant toward the bearing 75 to keep the bearing lubricated at all times. This serves to prevent the bearing 75 from seizing after the soot blower assembly 14 has been in use for a period of time.

The rotary drive assembly 58 is connected to the drive shaft 66 projecting through the lower mounting plate 49 as best seen in FIG. 3. The rotary drive assembly 58 includes a housing 86 mounted on the lower mounting plate 49 depending therebelow. The housing 86 rotatably mounts the lower projecting end of the drive shaft 66 so that the lower end of the lance 55 is maintained centered about the axis $A_E$. A driven bevel gear 88 is mounted on the driveshaft 66 within the housing 86 and an input drive shaft 89 is rotatably mounted between the housing 86 and the housing 11 so that the input drive shaft 89 projects exteriorly of the housing 11, across the flue gas passage 24 and into the housing 86. The inboard end of the input drive shaft 89 is provided with a drive bevel gear 90 which meshes with the driven bevel gear 88 so that, when the input drive shaft 89 is rotated, the lance 55 is rotated through the bevel gears 88 and 90. The outboard end of the input drive shaft 89 is provided with an appropriate drive mechanism 91 located exteriorly of the housing 11. The drive mechanism 91 illustrated is a chain wheel type drive mechanism.

Figure 5:
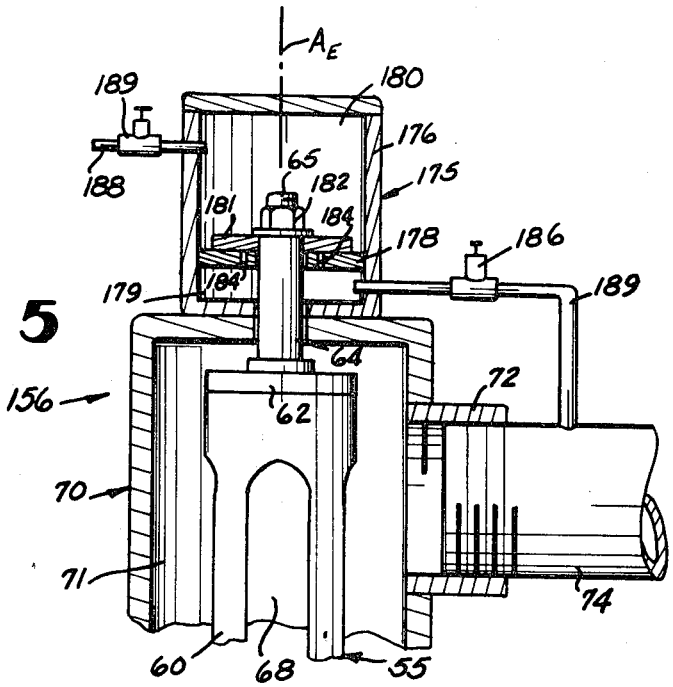
FIG. 5 is a cross-sectional view similar to FIG. 4 showing a second embodiment of the rotary head of the soot blower assembly.

An alternate embodiment of a rotary head assembly for the soot blower assembly 14 is illustrated in FIG. 5 and has been designated by the reference 156. The rotary head assembly 156 includes the base housing 70 defining the cavity 71 therein and equipped with nipple 72 and inlet pipe 74 the same as for rotary head assembly 56. A gas bearing unit 175 is provided on top of the housing 70 to rotatably support the lance 55.

The gas bearing unit 175 includes a gas bearing housing 176 mounted on top of the base housing 70 with a bearing chamber therein into which the mounting shaft 64 on the lance 55 projects. A lower bearing plate 178 oriented normal to the axis $A_E$ is mounted in housing 176 in the bearing chamber and divides the chamber into a lower subchamber 179 between plate 178 and the lower end of housing 176 and an upper subchamber 180 thereabove. The lower bearing plate 178 defines a central hole therethrough through which the mounting shaft 64 rotatably extends. An upper bearing plate 181 is mounted on the upper end of shaft 64 in the upper subchamber 180 by a nut and washer assembly 182 threadedly engaging the stud 65 on shaft 64. The upper bearing plate 181 is supported on top of the lower bearing plate 178 to limit the downward movement of lance 55. A plurality of small passages 184 are defined through the lower bearing plate 178 underneath the upper bearing plate 181 so that when a fluid under pressure is introduced into the lower subchamber 179, the fluid can pass up through the passages 184 against the upper bearing plate 181 to lift the upper bearing plate 181 off of the lower bearing plate 178 so that the upper bearing plate 181 is supported on the fluid as will become more apparent. This rotatably supports the upper bearing plate 181 and thus the lance 55 on the fluid passing between plates 178 and 181 so that the lance 55 can be freely rotated about the axis $A_E$.

Fluid under pressure is supplied to the lower subchamber 179 via a pipe 185 from the inlet pipe 74 supplying the cleaning gas to the housing 70. The pipe 185 is provided with an appropriate control valve 186 to regulate the pressure and flow of fluid to the lower subchamber 179. A portion of the cleaning gases supplied to the soot blower assembly 14 are thus diverted into the lower subchamber 179 to pressurize same and lift the upper bearing plate 181 off of the lower bearing plate 178. This allows the cleaning gas to flow outwardly between the bearing plates 178 and 181 into the upper subchamber 180. A vent pipe 188 is provided to vent the cleaning gas out of the upper subchamber 180 and may be equipped with a control valve 189 to control the rate of flow of the cleaning gas out of upper subchamber 180 to prevent a pressure buildup therein.

In operation, the valve 186 is adjusted so that the cleaning gas supplied to the lower subchamber 179 is just sufficient to maintain clearance between the upper and lower bearing plates 178 and 181 to permit the upper bearing plate 181 to freely rotate with respect to the lower bearing plate 179. When the cleaning gas is not being supplied to the soot blower assembly, the upper bearing plate 181 will be supported on the lower bearing plate 179. However, as soon as the cleaning gas is supplied to the soot blower assembly, the upper bearing plate 181 is lifted to free the lance 55 for rotation. This does not, however, detract from the operation of the soot blower assembly since it is only desired to rotate the lance 55 while the cleaning gas is being supplied thereto.

Figure 6:
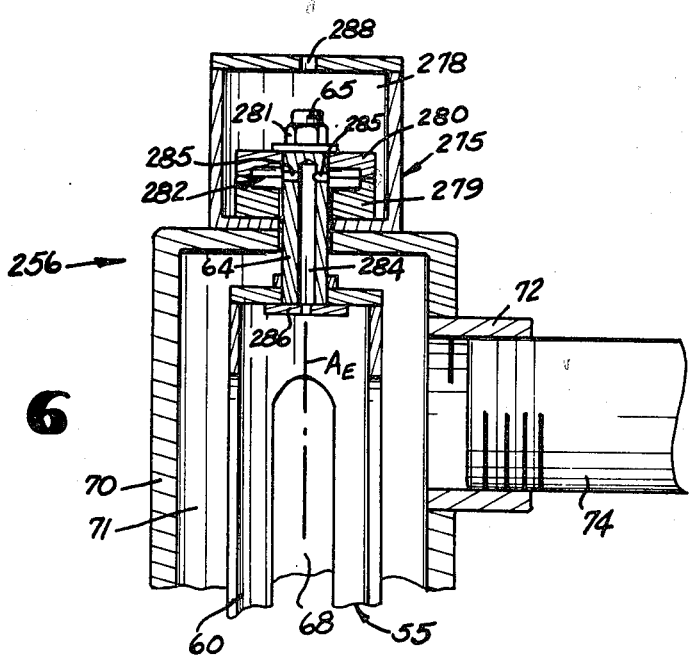
FIG. 6 is a cross-sectional view similar to FIG. 4 showing a third embodiment of a rotary head of the soot blower assembly.

An alternate embodiment of a rotary head assembly for the soot blower assembly 14 is illustrated in FIG. 6 and has been designated by the reference 256. The rotary head assembly 256 includes the base housing 70 defining the cavity 71 therein and equipped with nipple 72 and inlet pipe 74 the same as for rotary head assembly 56. A gas bearing unit 275 is provided on top of the housing 70 to rotatably support the lance 55.

The gas bearing unit 275 includes a gas bearing housing 276 mounted on top of the base housing 70 with a bearing chamber 278 therein into which the mounting shaft 64 on the lance 55 projects. A lower bearing plate 279 oriented normal to the axis $A_E$ is mounted in housing 276 in the bottom of bearing chamber 278 and defines a central hole therethrough through which the mounting shaft 64 rotatably extends. An upper bearing plate 280 is mounted on the upper end of shaft 64 in the bearing chamber 278 by a nut and washer assembly 281 threadedly engaging the stud 65 on shaft 64. The upper bearing plate 280 is supported on top of the lower bearing plate 279 to limit the downward movement of lance 55.

The bearing plates 279 and 280 are recessed around the mounting shaft 64 to complementarily form a fluid receiving space 282 around the mounting shaft 64 at their juxtaposed sides. The lance 55 has modified by forming a supply passage 284 from the upper end of the passage 61 in pipe 60 axially out along the mounting shaft 64 to a position in lateral alignment with the space 282. Cross ports 285 extend through shaft 64 normal to its axis and in registration with the space 282 between plates 279 and 280 so that the space 282 is in communication with the supply passage 282.

When the pressurized cleaning gas is supplied to the lance 55, the gas can pass up through the passage 284 and cross ports 285 into the space 282 between bearing plates 279 and 280 to pressurize same and lift the upper bearing plate 280 off of the lower bearing plate 279 to permit the upper bearing plate 280 and thus the lance 55 to freely rotate with respect to the lower bearing plate 279. It will be appreciated that, as long as the gas pressure and flow rate is sufficient to maintain the bearing plates 279 and 280 separated, this construction is self-regulating in that a steady state spacing between the plates 279 and 280 will be reached so that the rate at which the gas escapes from between the plates will be such that the weight of the lance 55 and the associated parts supported by the upper bearing plate 280 will be equalled by the upward forces exerted on plate 280 by the gas.

An orifice plate 286 may be provided at the inlet end of the passage 284 to regulate the flow of cleaning gas to the bearing plates 279 and 280. The bearing chamber 278 is vented at 288 to permit the cleaning gas escaping from between the bearing plates 279 and 280 to exit chamber 278 and prevent a back pressure buildup therein. Typically, the size of the orifice in the orifice plate 286 is selected so that the cleaning gas supplied between plates 279 and 280 is just sufficient to maintain clearance between the upper and lower bearing plates to permit the upper bearing plate 280 to freely rotate with respect to the lower bearing plate 279. When the cleaning gas is not being supplied by the soot blower assembly, the upper bearing plate 280 will be supported on the lower bearing plate 279. However, as soon as the cleaning gas is supplied to the soot blower assembly, the upper bearing plate 280 is lifted to free the lance 55 for rotation. This does not, however, detract from the operation of the soot blower assembly since it is only desired to rotate the lance 55 while the cleaning gas is being supplied thereto.

Figure 7:
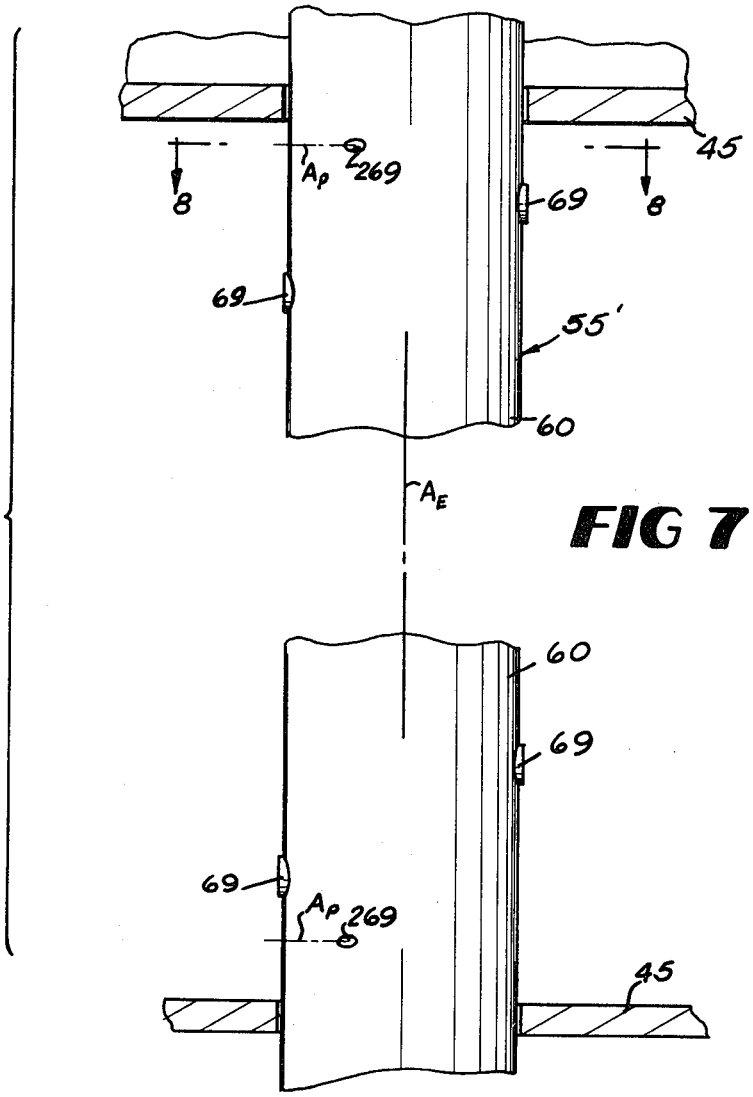
FIG. 7 is an enlarged side view of a portion of the soot blower lance showing a construction for rotating the soot blower lance.
Figure 8:
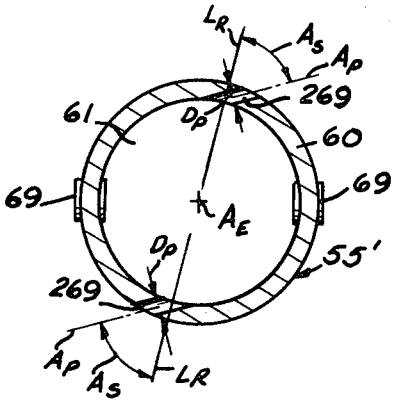
FIG. 8 is an enlarged horizontal cross-sectional view taken generally along lines 8—8 of FIG. 7.
Figure 9:
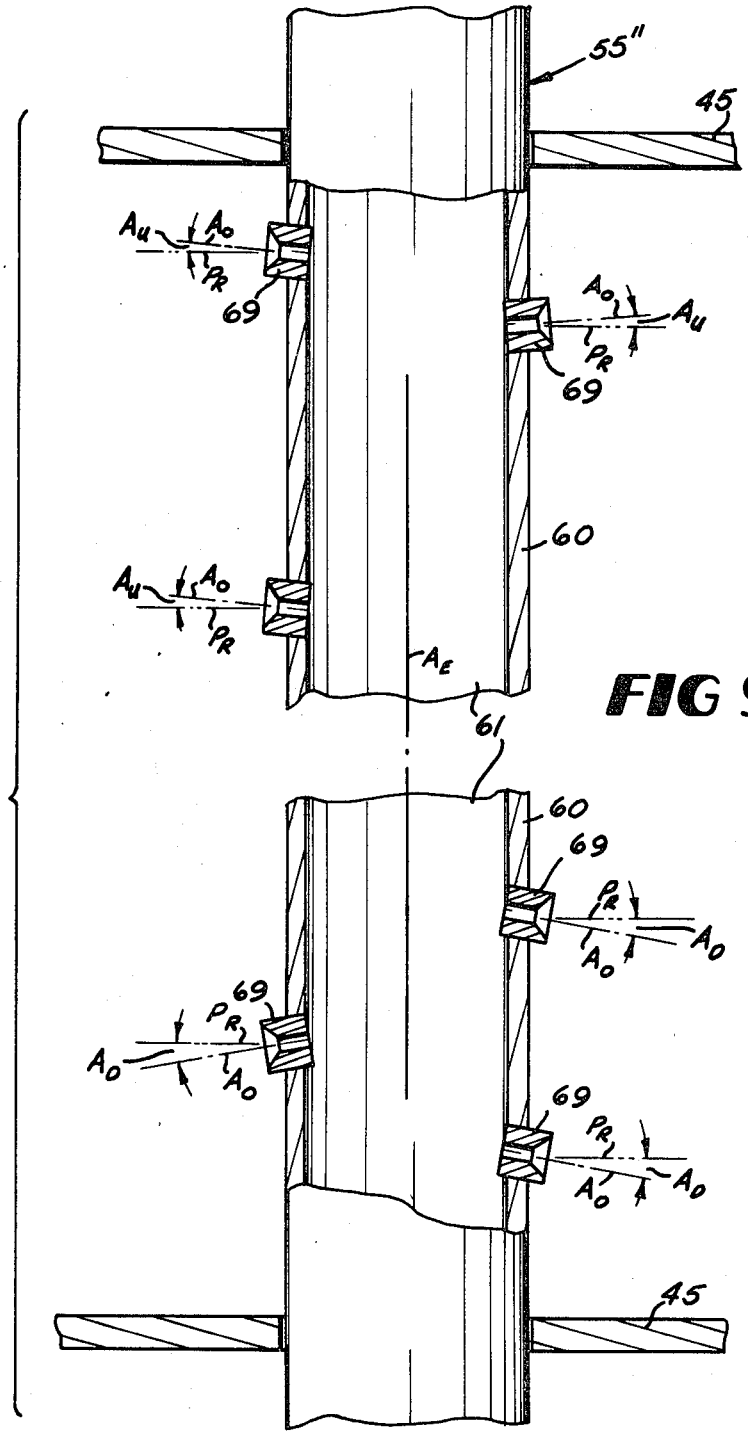
FIG. 9 is a vertical cross-sectional view of the soot blower lance showing a vertical positioning construction.

An alternate construction for rotating the soot blower lance is illustrated in FIGS. 7 and 8 for use in lieu of the mechanical rotary drive assembly 58. This construction is incorporated in the lance which has been designated 55'. The construction of lance 55' is the same as lance 55 except as described below.

In addition to the radially oriented orifices 69, a plurality of jet passages 269 are provided through the pipe 60. While the number and location of the jet passages 269 may be varied as desired, two sets of these passages are illustrated. One set of the passages 269 illustrated is defined through pipe 60 at a position in the opening 44 through the heat transfer coil assembly 12 just below the uppermost baffle plate 45 while the other set of the passages 269 is defined through the pipe 60 adjacent its lower end.

Each of the passages 269 is oriented so that its axis $A_P$ lies in a plane normal to the axis $A_E$ of the pipe 60 so that the axis $A_P$ is angularly shifted by an angle $A_S$ from a radial line $L_R$ from axis $A_E$ as best seen in FIG. 8. It will be noted that the jet passage axis $A_P$ of each of the jet passages 269 is angularly shifted from the radial line $L_R$ in the same sense as will become more apparent. For instance, all of the axes $A_P$ illustrated are angularly shifted from the radial lines $L_R$ in a clockwise direction. It is to be further understood that all of the axes $A_P$ could just as well be angularly shifted in the opposite sense.

When the pressurized cleaning fluid is supplied to the passage 61 in the lance 55', a portion of the cleaning fluid is directed through the jet passages 269. This produces a reaction force moment on the lance 55' to rotate it about its central axis. The magnitude of this moment is determined by the cleaning fluid pressure, the jet passage diameter $D_P$, and the angle $A_S$. These values are selected such that the rotary force moment is sufficient to rotate the lance 55' at the desired rate of rotation. With the jet passages 269 located in pipe 60 at opposite ends of the opening 44 through the heat transfer coil assembly 12, the lance 55' is stabilized on the economizer axis $A_E$.

In some instances, it may be desirable to reduce the axial loading exerted on the rotary head assembly by the soot blower lance when the pressurized cleaning fluid is supplied to the soot blower assembly. Typically, a net downwardly directed axial loading is exerted on the lance by the cleaning fluid in the cavity 71 in the base housing 70 of the rotary head assembly 56. FIG. 8 illustrates a soot blower lance 55" which has been modified to compensate for such loading.

As seen in FIG. 8, some of the orifices 69 are oriented so that the orifice axis $A_O$ of each is shifted below the reference plane $P_R$ normal to the axis $A_E$ by angle $A_D$ while some of the orifices 69 are oriented so that the orifice axis $A_O$ of each is shifted above the reference plane $P_R$ normal to the axis $A_E$ by angle $A_U$. Thus, it will be seen that those orifices 69 directed below plane $P_R$ generate an upward force on lance 55" while those orifices 69 directed above plane $P_R$ generate a downward force on lance 55". The angles $A_D$ and $A_U$ are selected so that the axial loading on lance 55" by the pressurized cleaning fluid is offset by the reaction forces exerted on the lance 55" as the cleaning fluid passes through orifices 69.

What is claimed as invention is:

1. An economizer construction for use in recovering heat from flue gases passing upwardly through a vertical stack via a heat transfer fluid and adapted to be cleaned with a pressurized fluid comprising:

a housing defining a generally vertically extending flue gas passage therethrough about a generally vertical central axis;

a helically wound heat transfer coil positioned in said flue gas passage for placing the heat transfer fluid in a heat exchange relation with the flue gases passing through said flue gas passage, said heat transfer coil defining a generally vertically extending opening centrally therethrough concentrically of said central axis and having a first prescribed diameter; and a soot blower assembly including an elongate soot blower lance having an outside diameter smaller than said first prescribed diameter of said central opening through said heat transfer coil, mounting means for rotatably positioning said soot blower lance within said central opening through said coil so that the longitudinal axis of said lance is generally coaxially oriented along said central axis; drive means for selectively rotating said lance about said central axis, and fluid supply means for supplying the pressurized cleaning fluid to said lance, said lance defining a fluid passage therein in communication with said fluid supply means and defining a plurality of orifices therein for directing streams of the pressurized cleaning fluid from within said fluid passage across said central opening and onto said heat transfer coil to clean same and said mounting means including gas bearing means attached to said lance and control means for supplying pressurized fluid to said gas bearing means to operate said gas bearing means so that said gas bearing means rotatably supports said lance while pressurized cleaning fluid is supplied to said lance; wherein said lance includes a mounting shaft on the upper end thereof and wherein said gas bearing means includes a gas housing defining a fluid chamber therein into which said mounting shaft rotatably extends; a lower bearing plate mounted in said fluid chamber and dividing said fluid chamber into a lower subchamber below said lower bearing plate and upper subchamber above said lower bearing plate, said lower bearing plate defining a central opening therethrough through which said mounting shaft rotatably extends into said upper subchamber; an upper bearing plate attached to said mounting shaft in said upper subchamber so that said lance is supported thereby with said upper bearing plate overlying said lower bearing plate, said lower bearing plate defining fluid passages therethrough and said control means constructed and arranged to supply the pressurized cleaning fluid into said lower subchamber whereby the pressurized cleaning fluid passes through said fluid passages in said lower bearing plate to lift said upper bearing plate off of said lower bearing plate and maintain separation between said bearing plates when the pressurized cleaning fluid is supplied to said lance so that said lance is rotatably supported.

2. The economizer construction of claim 1 further including vent control means for selectively controlling the flow of the cleaning fluid from said upper subchamber in said gas housing after passage from between said bearing plates to maintain the separation between said bearing plates when the pressurized cleaning gas is supplied thereto.

3. The economizer construction of claim 1 wherein said orifices are constructed and arranged so the pressurized cleaning fluid flowing therethrough generates a reaction force on said lance offsetting the axially directed forces exerted on said lance by said cleaning fluid prior to passage through said orifices.

4. The economizer construction of claim 3 wherein said drive means includes a plurality of jet passages defined through said lance for directing the pressurized cleaning fluid from within said fluid passage out through said lance so as to generate a rotational moment on said lance when said fluid supply means supplies pressurized cleaning fluid to said fluid passage to rotate said lance.

5. The economizer construction of claim 4 further including baffle means located within said opening through said heat transfer coil forcing the flue gases flowing through said flue gas passage out of said opening and into heat exchange contact with said heat transfer coil.

6. The economizer construction of claim 3 further including baffle means located within said opening through said heat transfer coil forcing the flue gases flowing through said flue gas passage out of said opening and into heat exchange contact with said heat transfer coil.

7. The economizer construction of claim 1 further including baffle means located within said opening through said heat transfer coil forcing the flue gases flowing through said flue gas passage out of said opening and into heat exchange contact with said heat transfer coil.

8. The economizer construction of claim 1 wherein said drive means includes a plurality of jet passages defined through said lance for directing the pressurized cleaning fluid from within said fluid passage out through said lance so as to generate a rotational moment on said lance when said fluid supply means supplies pressurized cleaning fluid to said fluid passage to rotate said lance.

9. The economizer construction of claim 8 further including baffle means located within said opening through said heat transfer coil forcing the flue gases flowing through said flue gas passage out of said opening and into heat exchange contact with said heat transfer coil.

* * * * *